US009687688B2

(12) United States Patent
Hsiao

(10) Patent No.: US 9,687,688 B2
(45) Date of Patent: Jun. 27, 2017

(54) WAIST TRAINING DEVICE

(71) Applicant: Liang Lang Hsiao, Changhua County (TW)

(72) Inventor: Liang Lang Hsiao, Changhua County (TW)

( * ) Notice: Subject to any disclaimer, the term of this patent is extended or adjusted under 35 U.S.C. 154(b) by 59 days.

(21) Appl. No.: 14/881,311

(22) Filed: Oct. 13, 2015

(65) Prior Publication Data

US 2017/0100620 A1 Apr. 13, 2017

(51) Int. Cl.
*A63B 19/00* (2006.01)
*A63B 21/06* (2006.01)

(52) U.S. Cl.
CPC ..... *A63B 19/00* (2013.01); *A63B 21/0618* (2013.01)

(58) Field of Classification Search
CPC ..... A63B 19/00–19/04; A63B 21/0608; A63B 21/22–21/222; A63B 21/4009
See application file for complete search history.

(56) References Cited

U.S. PATENT DOCUMENTS 4,356,902 A * 11/1982 Murphy ..... A61H 3/008 193/35 R
6,431,991 B1 * 8/2002 Kossnar ..... A63B 69/3608 473/216
7,758,480 B1 * 7/2010 Chen ..... A63B 19/00 482/105

* cited by examiner

*Primary Examiner* — Joshua Lee
*Assistant Examiner* — Jennifer M Deichl
(74) *Attorney, Agent, or Firm* — Rosenberg, Klein & Lee

(57) ABSTRACT

A waist training device includes unit members of arc shaped and adapted to be assembled as a ring. The inner diameter of the ring is determined by the number of the unit members. Each unit member defines a passage, and the passages of the unit members are connected with each other to form a rail extended annularly along the ring. For each member, a pair of pivot shafts is located at one end of the passage, and a pair of pivot holes is located at the other end of the passage. The pivot shafts of each unit member are pivotally assembled with the pivot holes of an adjacent unit member. A counter weight member is assembled in the rail. The counter weight member has a seat connected to a counter weight block. The counter weight member moves along the rail by the sliding of the seat in the rail.

13 Claims, 9 Drawing Sheets

WAIST TRAINING DEVICE

BACKGROUND OF THE INVENTION

Field of the Invention

The present invention relates to a body training device, and more particularly to a waist training device.

Description of the Prior Art

Many people train their waists by hula hoops. However, because the inner diameter of the hula hoop is much greater than the waistline of the user, users, especially unexperienced users, can hardly control the hula hoop to keep the hula hoop to rotate on the waist. Once the hula hoop falls from the waist, the user cannot perform the training anymore. Moreover, when the user shakes his/her waist improperly, the waist of the user may get hurt.

Accordingly, improved waist training products are developed. For example, as disclosed in a PCT patent publication (publication number WO 94/12242), a waist sporting equipment has a ring assembly, and a weight body is slidably assembled to the ring assembly, so that the ring assembly can be assembled to the waist of a user, and the user can shake waist to allow the weight body to move along the ring assembly. Consequently, the user can perform waist training. However, the inner diameter of the ring assembly is fixed, so the waist sporting equipment cannot be adapted to users with different body shapes. Accordingly, the waist sporting equipment further has an elastic band assembled in the ring assembly to firmly position with the waist of the user. However, the positioning performance of the elastic band is not good enough, so that the ring assembly would fall from the waist when the user shakes waist.

Another device for exercising waist, as disclosed in a Taiwan patent (patent number M458992), the device has a ring assembly, and the ring assembly has an adjustable section whose length can be adjusted slightly, so that the overall length of the ring assembly can be changed, and the inner diameter of the ring assembly can be adjusted for users with different body shapes. However, the variation in length of the adjustable section is not broad enough to meet different user requirements.

The present invention is, therefore, arisen to obviate or at least mitigate the above mentioned disadvantages.

SUMMARY OF THE INVENTION

One object of the present invention is to provide a waist training device, which is formed by several unit members, the length of the waist training device can be changed by adjusting the number of the unit members. Therefore, the waist training device is suitable for users with different body shapes.

Another objective of the present invention is to provide simple connecting structures for the unit members, so that the waist training device can be assembled and disassembled rapidly.

To achieve the above and other objects, a waist training device is provided and comprises a plurality of unit members and a counter weight member. The unit members are of arc shaped and adapted to be assembled as a ring. The inner diameter of the ring is determined by the number of the unit members. Each of the unit members has a bottom wall and two sidewalls flexibly assembled to the bottom wall. A passage is defined between the two sidewalls, and the passages of the unit members are connected with each other to form a rail extended annularly along the ring. A pair of pivot shafts is defined at first ends of the sidewalls of each of the unit members. A pair of pivot holes is defined at second ends of the sidewalls of each of the unit members. The first ends are opposite to the second ends. The pivot shafts of each of the unit members are pivotally assembled with the pivot holes of one of two adjacent unit members. The counter weight member comprises a seat slidably assembled on the rail, and a counter weight block is connected to the seat.

Wherein, a guiding tapered section is formed on each of the sidewalls and near to the corresponding pivot hole, and a stopping portion is assembled on each of the sidewalls and atop the corresponding pivot hole.

In one embodiment, one of the unit members is defined as a connecting member. Two guiding grooves are defined on the connecting member and respectively correspond to the two pivot holes of the connecting member, so that the pivot shafts of one of two adjacent unit members are guided by the guiding grooves of the connecting member and inserted into the pivot holes of the connecting member. Two buckling members are pivoted with the connecting member and respectively correspond to the two pivot holes of the connecting member. Each of the buckling members is inserted into the corresponding guiding groove by means of pivot and buckled with the corresponding pivot shaft of the adjacent unit member.

Preferably, the seat is formed by two slide units pivoted with each other, and the seat and the counter weight block are connected by a length adjustable rope.

Preferably, each of the unit members defines a through hole, so that an elastic band is passing through the through holes of the unit members.

Preferably, a counter is assembled on the ring for sensing the times the seat passes through the counter.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
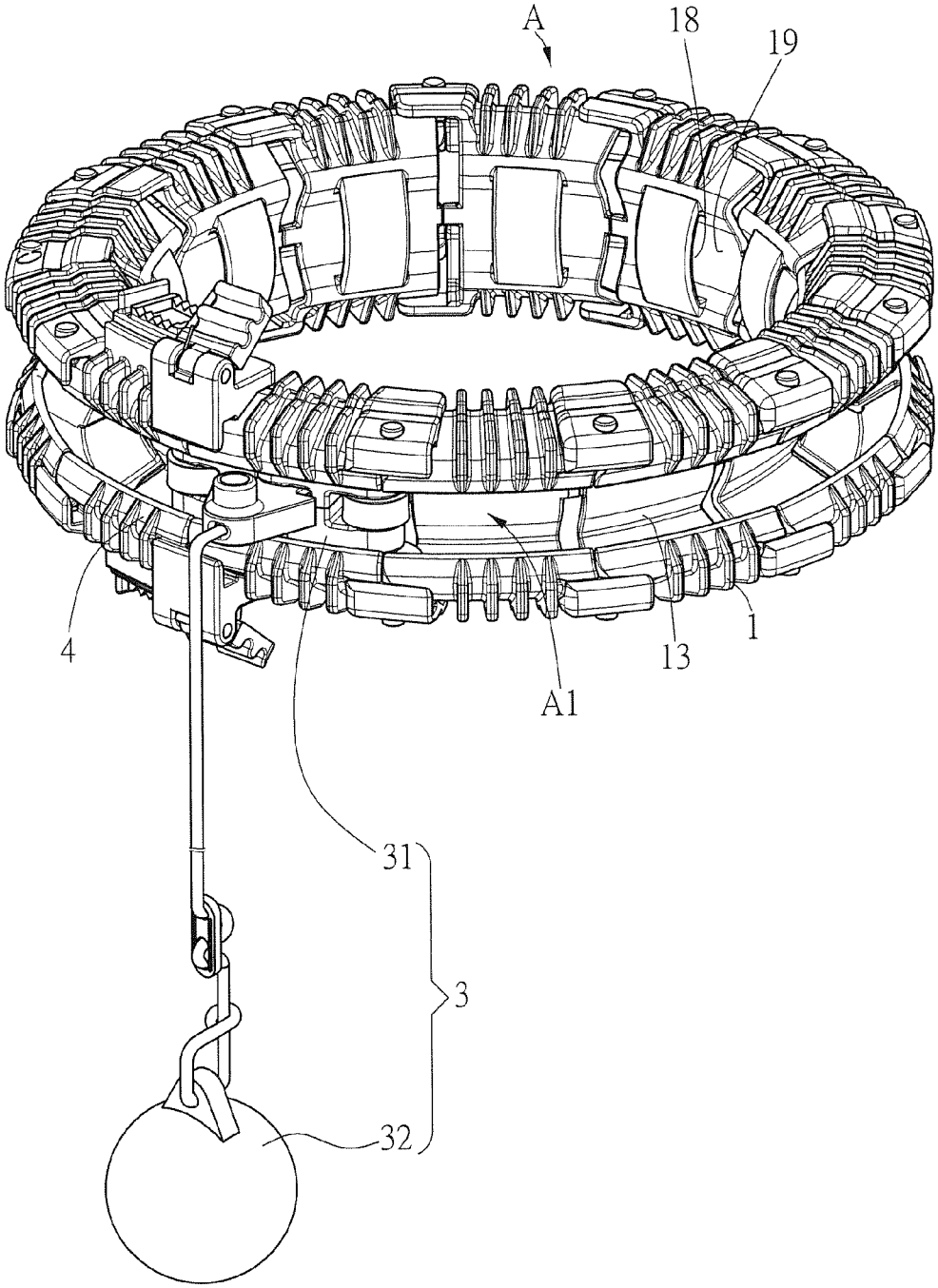
FIG. 1 illustrates a perspective view of a waist training device according to the present invention.
Figure 2:
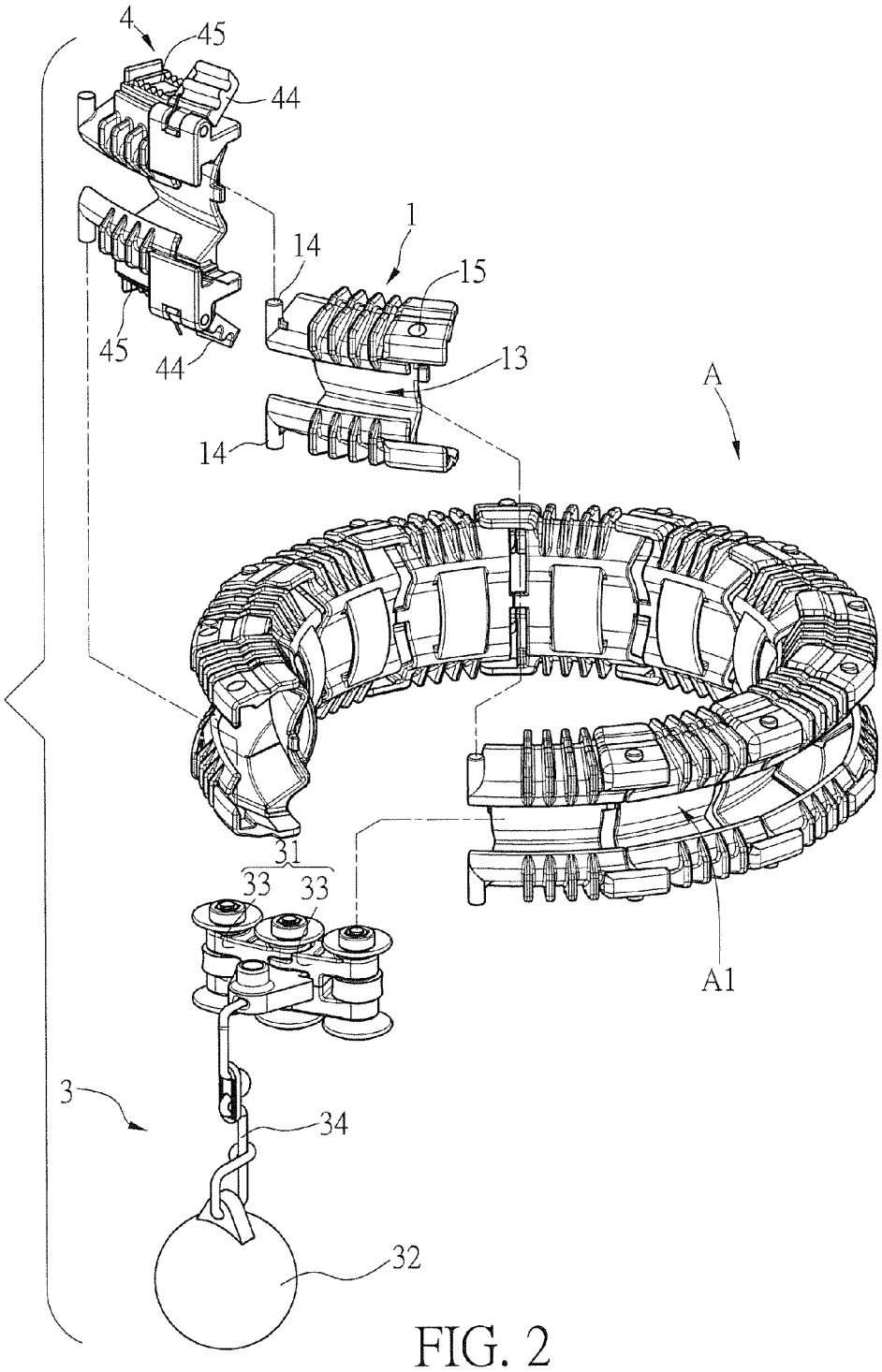
FIG. 2 illustrates an exploded view of the waist training device of the present invention.

Please refer to FIGS. 1 to 2, illustrating a waist training device according to the present invention. The waist training device comprises a ring A and a counter weight member 3. Specifically, a plurality of unit members 1, in arc shaped, is assembled with each other to form the ring A. The inner diameter of the ring A is determined by the number of the unit members 1. In detail, the more the unit members 1, the longer the length of the ring A, and the longer the inner diameter of the ring A. Accordingly, the number of the unit members 1 can be adjusted according to user's waistline, so that the inner diameter of the ring A mates with the waistline of the user, and the ring A can be firmly positioned on the waist. Therefore, the ring A can be adapted to users with different body shapes.

Figure 3:
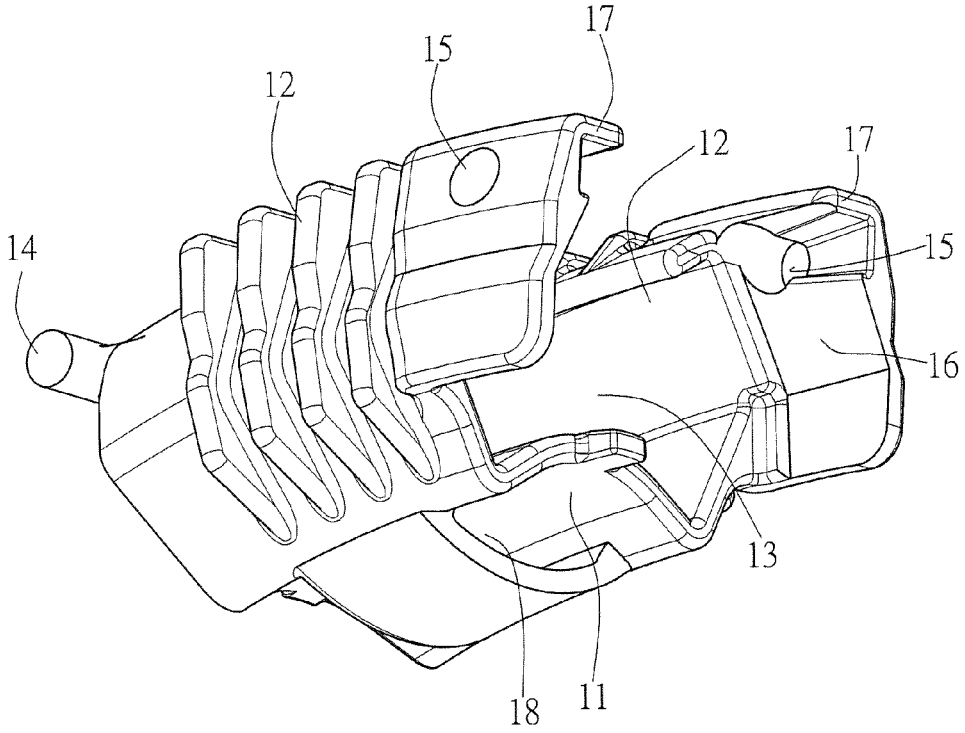
FIG. 3 illustrates a perspective view of a unit member of the waist training device of the present invention.

As shown in FIG. 3, each of the unit members 1 has a bottom wall 11 and two sidewalls 12 respectively standing at two sides of the bottom wall 11, so that the unit members 1 are approximately of U-shaped. The two sidewalls 12 are flexible, thus when an external force is applied to the sidewalls 12, the sidewalls 12 would deform slightly with respect to the bottom wall 11. A passage 13 is defined between the two sidewalls 12. When the unit members 1 are assembled with each other, the passages 13 of the unit members 1 are connected with each other to form a rail A1 extended annularly along the ring A (as shown in FIG. 1). Furthermore, two pivot shafts 14 are defined at first ends of the two sidewalls 12 and located at one of two ends of the passage 13, two pivot holes 15 are defined at second ends of the two sidewalls 12 and located at the other end of the passage 13, and the first end is opposite to the second end. A guiding tapered section 16 is formed on each of the sidewalls 12 and near to the corresponding pivot hole 15, and a stopping portion 17 is assembled on each of the sidewalls 12 and atop the corresponding pivot hole 15.

Figure 4:
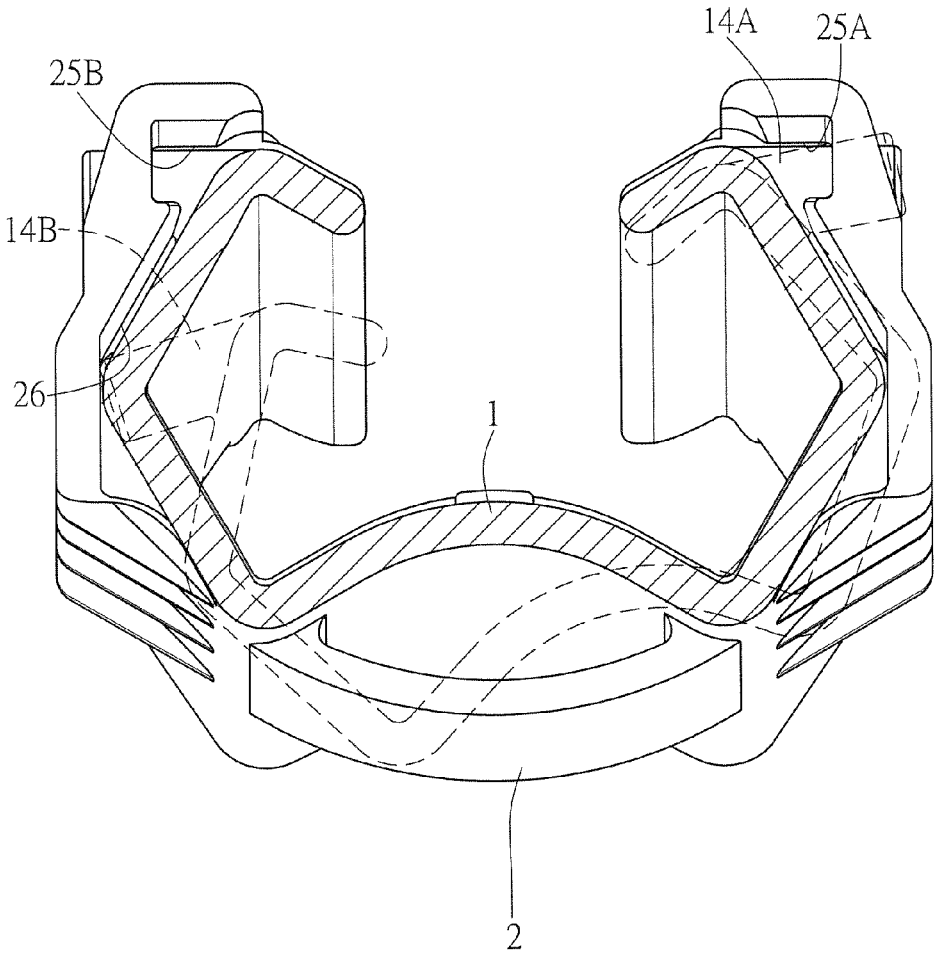
FIG. 4 illustrates a schematic operational view (1) of the unit members of the waist training device of the present invention.

According to the unit member 1 mentioned above, several unit members 1 can be assembled in order to form the ring A. Specifically, as shown in FIG. 4, firstly, one of the pivot shafts 14A of the unit member 1 is inclinedly engaged with one of the pivot holes 25A of the unit member 2, and the other pivot shaft 14B of the unit member 1 is abutted against the corresponding guiding tapered section 26 of the unit member 2. And then, the unit member 1 is rotated using the pivot shaft 14A as the rotating axis, so that the pivot shaft 14B is moved along the guiding tapered section 26 and inserted into the pivot hole 25B. Therefore, two adjacent unit members can be assembled with each other. Based on the above, several unit members can be assembled sequentially in an end-to-end manner to form the ring A.

Figure 5:
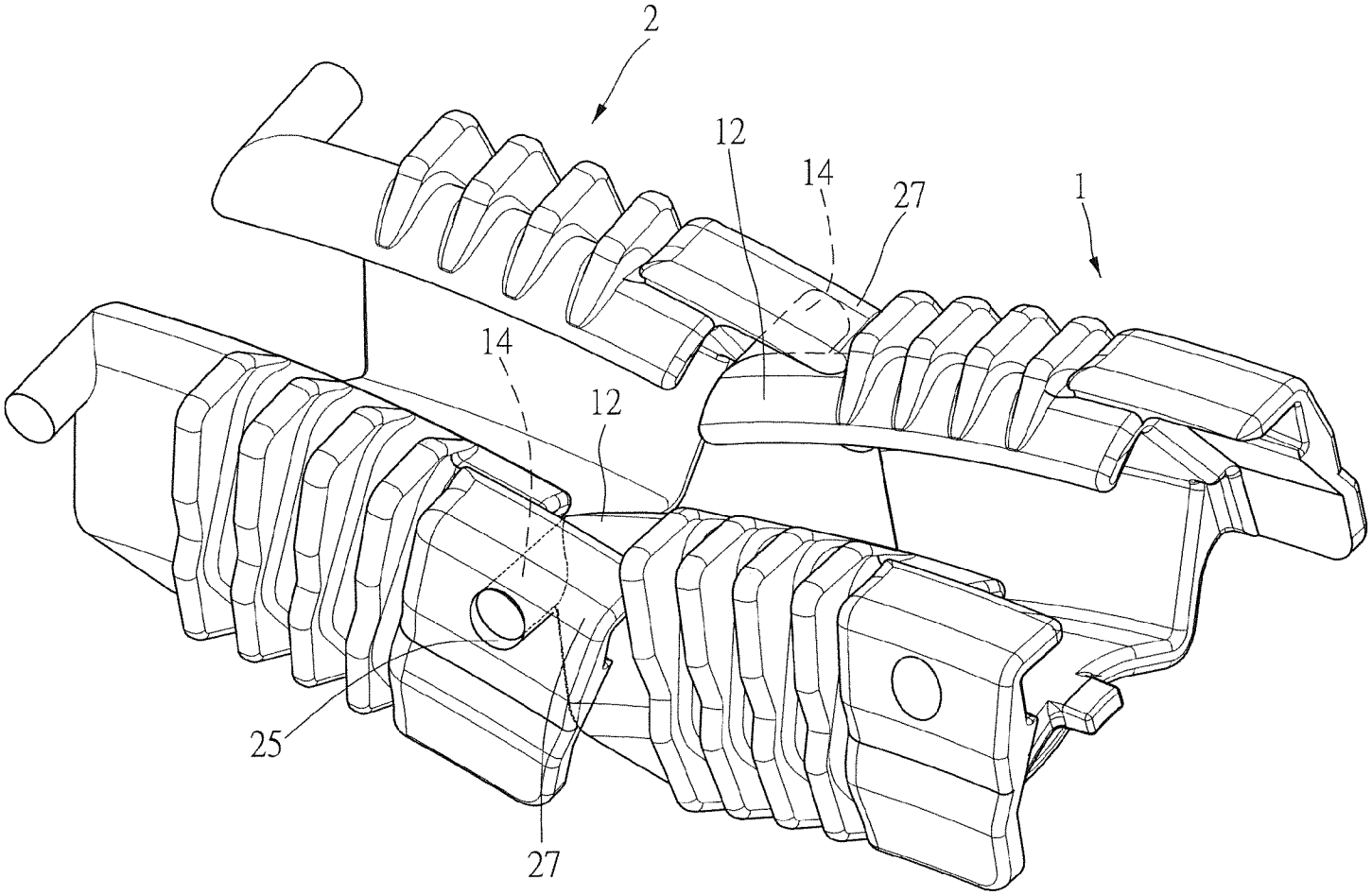
FIG. 5 illustrates a schematic operational view (2) of the unit members of the waist training device of the present invention.

Conversely, to disassemble the unit member 1 from the unit member 2, as shown in FIG. 5, the unit member 1 is pivotally rotated with respect to the unit member 2, so that the two sidewalls 12 of the unit member 1 are deformed due to the force applied by the two stopping portions 27 of the unit member 2, thereby the two pivot shafts 14 of the unit member 1 are detached from the pivot holes 25 of the unit member 2. Therefore, the unit member 1 can be detached from the unit member 2.

Figure 6:
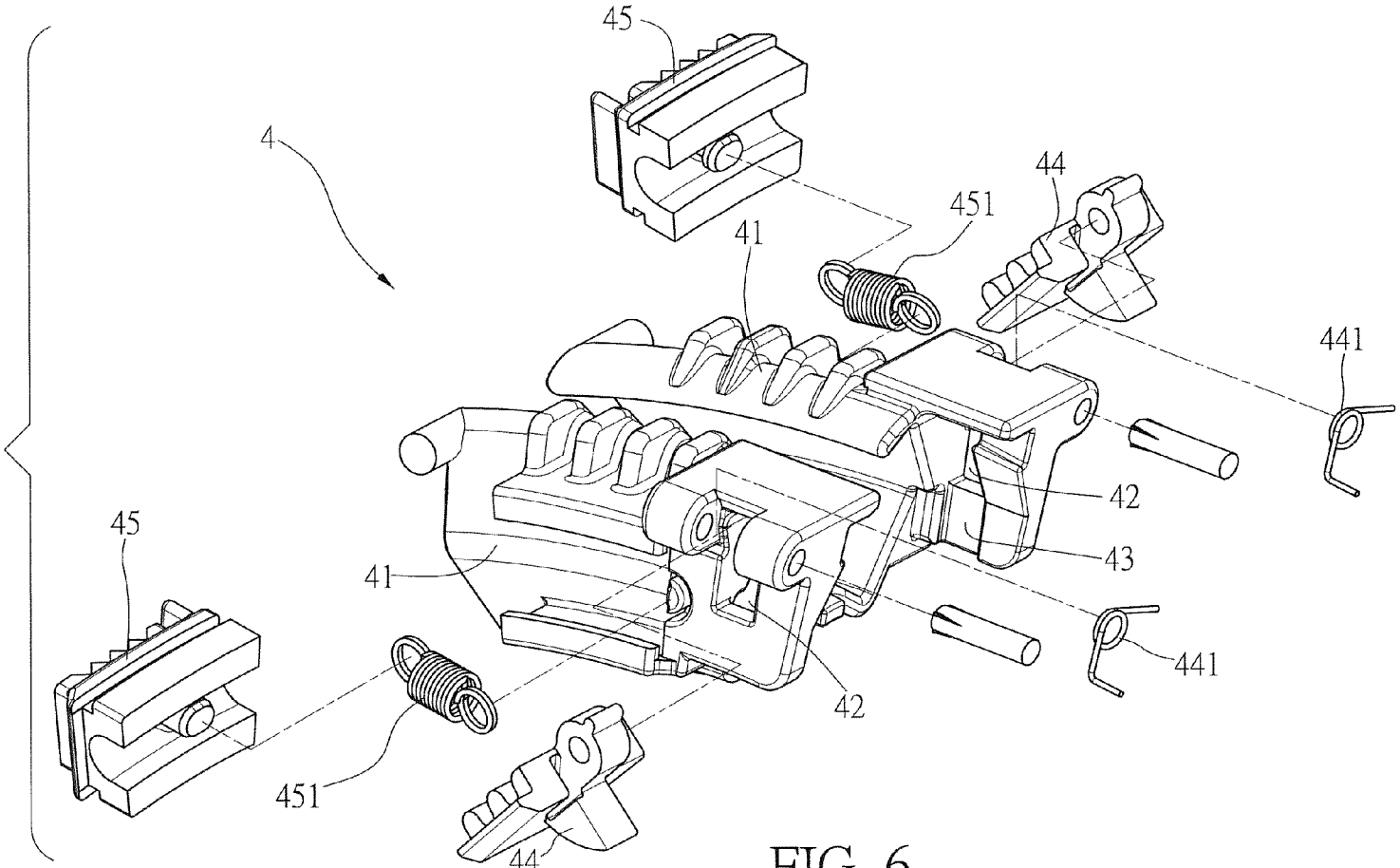
FIG. 6 illustrates an exploded view of a connecting member of the waist training device of the present invention.

In addition, in this embodiment, one of the unit members is defined as a connecting member. The connecting member has structures which facilitate the connecting member to be assembled with other unit members 1 conveniently, thus facilitating the assembling of the ring A. As shown in FIG. 6, the structure of the connecting member 4 is approximately the same as the structure of the unit member 1, except that two guiding grooves 43 are further defined on the connecting member 4 and respectively correspond to the two pivot holes 42 of the connecting member 4, so that the pivot shafts of one of two adjacent unit members are guided by the guiding grooves 43 of the connecting member 4 and inserted into the pivot holes 42 of the connecting member 4. Two buckling members are further pivoted with the connecting member 4 and respectively correspond to the two pivot holes 42 of the connecting member 4. Each of the buckling members comprises a first buckling block 44 and a second buckling block 45. The first buckling block 44 is pivoted on the sidewall 41 via a first spring 441, and the first buckling block 44 can be inserted into the corresponding guiding groove 43 by means of pivot, so that the first buckling block 44 can be buckled with the corresponding pivot shaft of the adjacent unit member. The second buckling block 45 is pivoted on the sidewall 41 via a second spring 451. The second spring 451 controls the position of the second buckling block 45, so that the second buckling block 45 can be engaged with the first buckling block 44.

Figure 7:
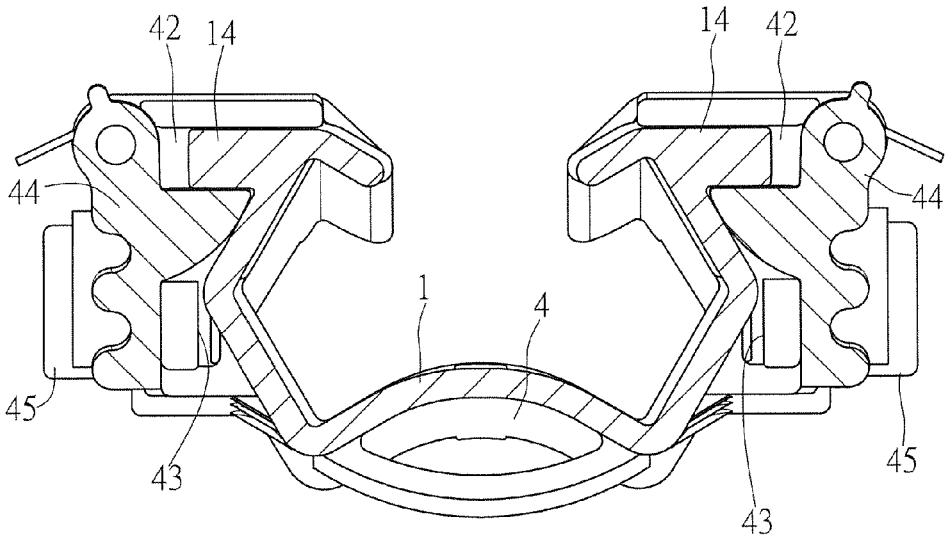
FIG. 7 illustrates a schematic operational view (1) of the connecting member and the unit members of the waist training device of the present invention.
Figure 8:
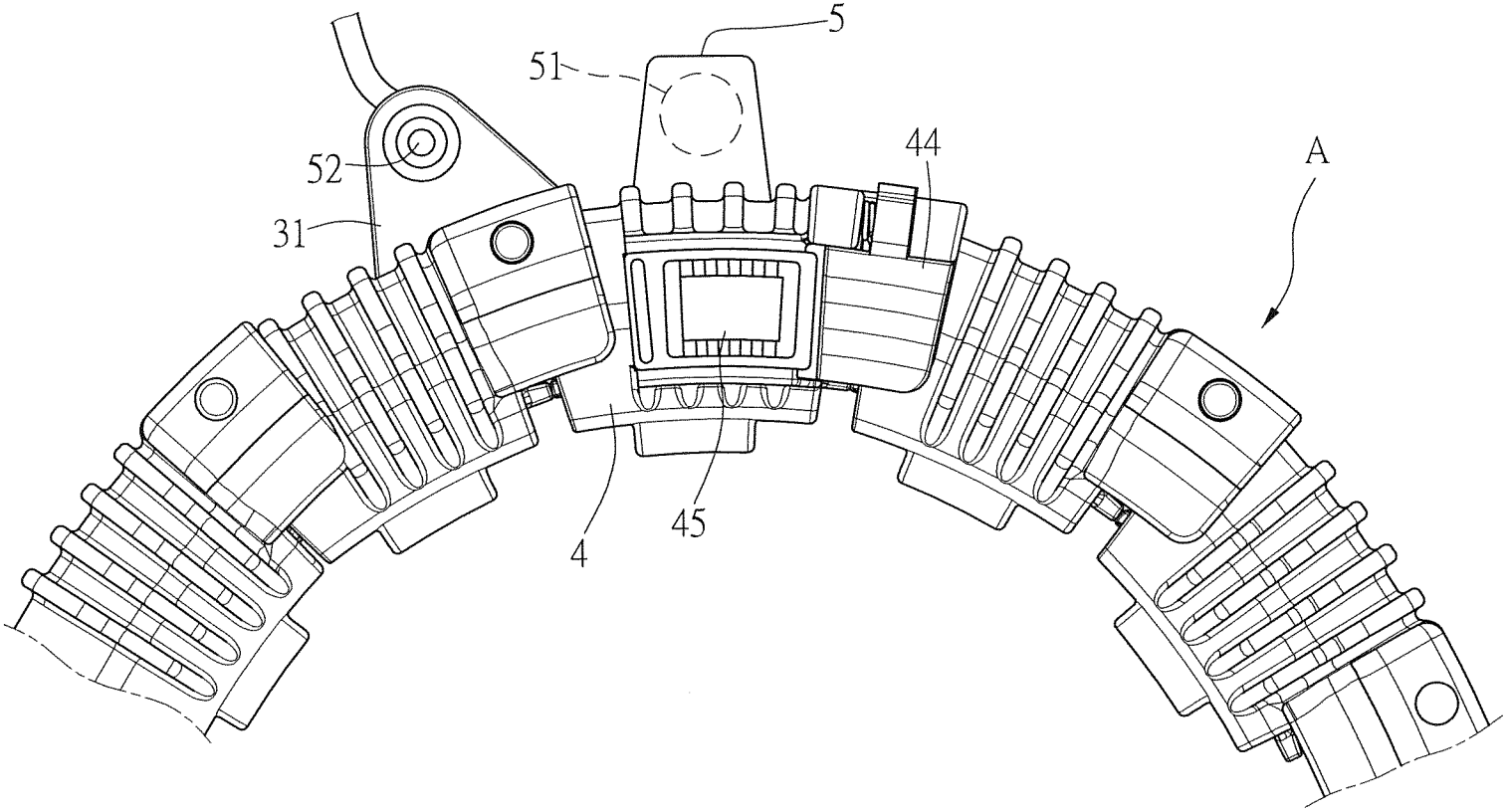
FIG. 8 illustrates a schematic operational view (2) of the connecting member and the unit members of the waist training device of the present invention.

Accordingly, as shown in FIG. 7 and FIG. 8, the connecting member 4 is configured as the head and followed by a series of unit members, and one of the pivot shafts 14 of the last unit member 1 in the series is guided by the corresponding guiding groove 43 of the connecting member 4 and inserted into the corresponding pivot hole 42 of the connecting member 4. Next, the first buckling block 44 is rotated so that the first buckling block 44 is inserted into the guiding groove 43 and buckled with the pivot shaft 14. Therefore, the connecting member 4 can be securely connected with the adjacent unit member 1. In addition, when the first buckling block 44 is rotated, the first buckling block 44 also pushes the second buckling block 45 away; while after the first buckling block 44 is buckled with the pivot shaft 14, the second buckling block 45 moves resiliently by the elastic force from the second spring 451, so that the second buckling block 45 engages with the first block 44. Consequently, the connecting member 4 can be firmly connected with the adjacent unit member 1.

The operations of the unit members for forming the ring are described as above. In this embodiment, as shown in FIG. 1, each of the unit members 1 further defines a through hole 18, an elastic band 19 is passing through the through holes 18 of the unit members 1, and two ends of the elastic band 18 are connected to form an elastic ring. The elastic ring is provided to firmly surround the ring A on the waist of a user, facilitating the mating between the ring A and the user's waist and preventing the user's body from being clamped by the unit members 1.

Figure 9:
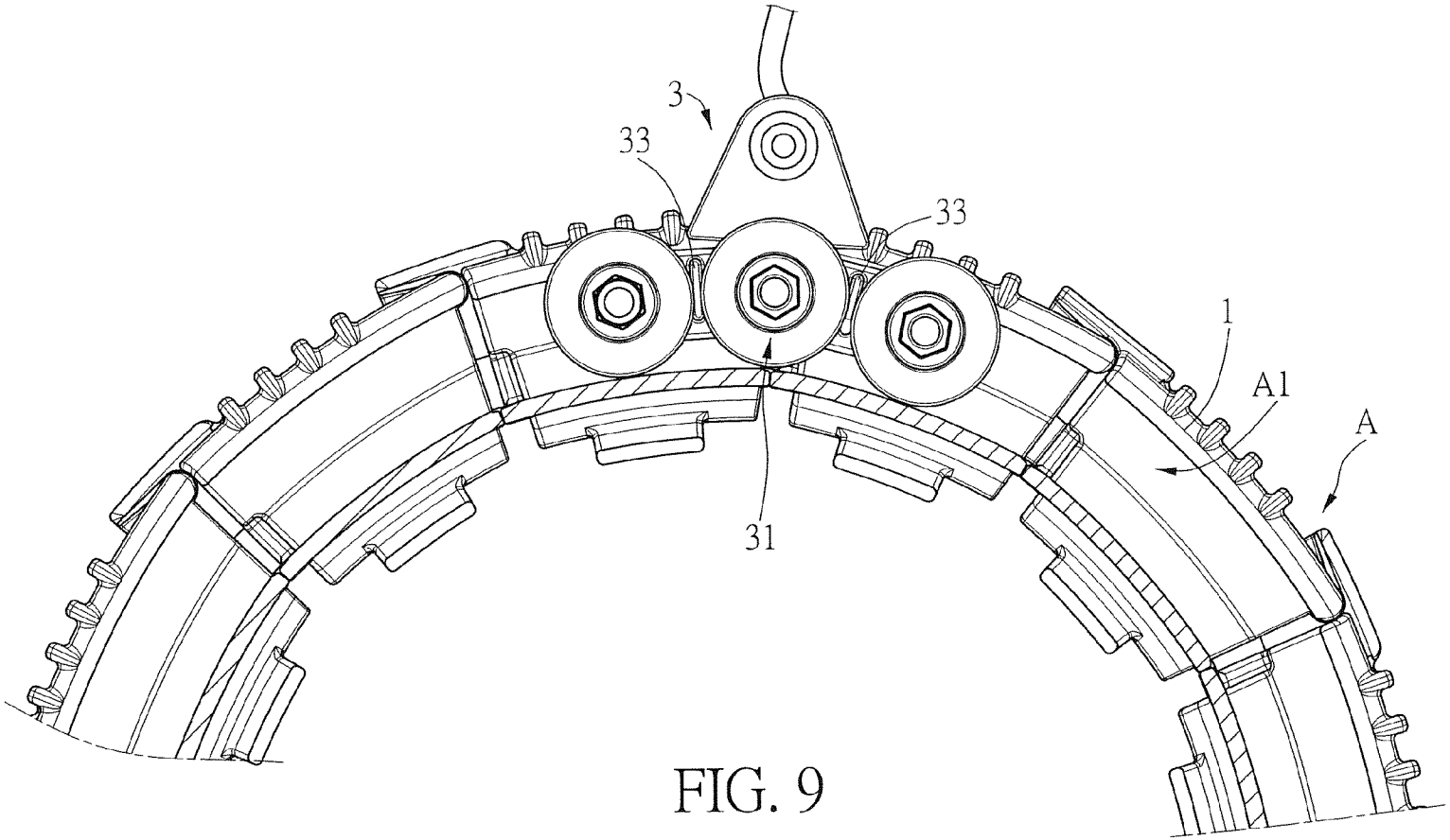
FIG. 9 illustrates a schematic view showing a counter weight member is assembled to the rail of the waist training device of the present invention.

Furthermore, the rail A1 of the ring A further has a counter weight member 3. Specifically, as shown in FIG. 2, the counter weight member 3 comprises a seat 31 and a counter weight block 32. The seat 31 is formed by two slide units 33 pivoted with each other. The two slide units 33 are pivotable with each other. The seat 31 and the counter weight block 32 are connected by a length adjustable rope 34. The seat 31 is slidably assembled on the rail A1. As shown in FIG. 9, the curvature of the rail A1 changes along with the change of number of the unit members 1. Since the two slide units 33 of the seat 31 are pivotable with each other to meet the curvature of the rail A1, the seat 31 can be slidably fitted on the rail A1. Therefore, the seat 31 can be smoothly moved along the rail A1.

In addition, in this embodiment, as shown in FIG. 8, a counter 5 is assembled to the connecting member 4. The counter 5 has a sensing element 51, while the seat 31 has a sensing element 52 corresponding to the counter 5. When the seats 31 meet with the counter 5, the two sensing elements 51, 52 generates a sensing, and the sensing is recorded by the counter 5. Accordingly, the times the counter weight member 3 traveling around the ring A caused by the shaking of the user's waist can be counted. The counter 5 may be a mechanical contact type counter, or may be an optical contactless type counter, embodiments are not limited thereto.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A waist training device, comprising:

a plurality of arc-shaped unit members, the unit members being adapted to be assembled as a ring, the ring having an inner diameter being determined by the number of the unit members, each of the unit members having a bottom wall and two sidewalls flexibly assembled to the bottom wall;

a passage being defined between the two sidewalls of each of the unit members, each passage of each of the unit members being connected with the passage of an adjacent unit member to form a rail extended annularly along the ring;

a pair of pivot shafts being defined at first ends of the sidewalls of each of the unit members;

a pair of pivot holes being defined at second ends of the sidewalls of each of the unit members, the first ends being opposite to the second ends, and the pivot shafts of each of the unit members being pivotally assembled with the pivot holes of one of two adjacent unit members; and a counter weight member having a seat, wherein the seat is slidably assembled on the rail, and a counter weight block is connected to the seat;

wherein a guiding tapered section is formed on each of the sidewalls and each guiding tapered section is adjacent to a respective one of the pair of pivot holes, and a stopping portion is assembled on each of the sidewalls and atop each pivot hole of the pair of pivot holes.

2. The waist training device according to claim 1, wherein one of the unit members is a connecting member, the connecting member further including:

two guiding grooves respectively adjacent to the pair of pivot holes; and two buckling members pivotally attached with the connecting member, each buckling member respectively corresponding to one of the pivot holes;

wherein the pivot shafts of an adjacent unit members are configured to be guided by the guiding grooves of the connecting member and configured to be inserted into the pivot holes of the connecting member, and wherein each of the buckling members is configured to be inserted into a corresponding one of the guiding grooves and configured to be buckled with a corresponding one of the pivot shafts of the adjacent unit member.

3. The waist training device according to claim 1, wherein the seat comprises two slide units pivotally attached to one another.

4. The waist training device according to claim 1, wherein the seat and the counter weight block are connected by a length adjustable rope.

5. The waist training device according to claim 1, wherein each of the unit members defines a through hole, and an elastic band extends through the through holes of the unit members.

6. The waist training device according to claim 1, wherein a counter is assembled to the ring for counting the number of times the seat passes through the counter.

7. The waist training device according to claim 6, wherein the counter and the seat each has a sensing element, the sensing elements generate a sensing signal when the sensing elements meet with each other, and the sensing signal is recorded by the counter.

8. A waist training device, comprising:

a plurality of arc-shaped unit members, the unit members being adapted to be assembled as a ring, the ring having an inner diameter being determined by the number of the unit members, each of the unit members having a bottom wall and two sidewalls flexibly assembled to the bottom wall;

a passage being defined between the two sidewalls of each of the unit members, each passage of each of the unit members being connected with the passage of an adjacent unit member to form a rail extended annularly along the ring;

a pair of pivot shafts being defined at first ends of the sidewalls of each of the unit members;

a pair of pivot holes being defined at second ends of the sidewalls of each of the unit members, the first ends being opposite to the second ends, and the pivot shafts of each of the unit members being pivotally assembled with the pivot holes of one of two adjacent unit members; and a counter weight member having a seat, wherein the seat is slidably assembled on the rail, and a counter weight block is connected to the seat;

wherein one of the unit members is defined as a connecting member, the connecting member further including:

two guiding grooves respectively adjacent to the pair of pivot holes; and two buckling members pivotally attached with the connecting member, each buckling member respectively corresponding to one of the pivot holes;

wherein the pivot shafts of an adjacent unit member are configured to be guided by the guiding grooves of the connecting member and configured to be inserted into the pivot holes of the connecting member, and wherein each of the buckling members is configured to be inserted into a corresponding one of the guiding grooves and configured to be buckled with a corresponding one of the pivot shafts of the adjacent unit member.

9. The waist training device according to claim 8, wherein the seat comprises two slide units pivotally attached to one another.

10. The waist training device according to claim 8, wherein the seat and the counter weight block are connected by a length adjustable rope.

11. The waist training device according to claim 8, wherein each of the unit members defines a through hole, and an elastic band extends through the through holes of the unit members.

12. The waist training device according to claim 8, wherein a counter is assembled to the ring for counting the number of times the seat passes through the counter.

13. The waist training device according to claim 12, wherein the counter and the seat each has a sensing element, the sensing elements generate a sensing signal when the sensing elements meet with each other, and the sensing signal is recorded by the counter.

* * * * *